US005152874A

United States Patent [19]

Keller

[11] Patent Number: 5,152,874

[45] Date of Patent: Oct. 6, 1992

[54] APPARATUS AND METHOD FOR REMOVING FLUID FROM A FIBROUS WEB

[75] Inventor: Samuel F. Keller, Beloit, Wis.

[73] Assignee: Beloit Corporation, Beloit, Wis.

[21] Appl. No.: 403,560

[22] Filed: Sep. 6, 1989

[51] Int. Cl.[5] ..... D21F 3/02

[52] U.S. Cl. ..... 162/358.4; 100/93 RP; 162/359.1

[58] Field of Search ..... 162/358, 360.1, 359, 162/DIG. 1, 205; 100/118, 153, 154, 93 RP

[56] References Cited

U.S. PATENT DOCUMENTS

| | | | |
|---|---|---|---|
| 4,287,021 | 9/1981 | Justus et al. | 162/358 |
| 4,324,613 | 4/1982 | Wahren | 162/111 |
| 4,738,752 | 4/1988 | Busker et al. | 162/358 |
| 4,874,469 | 10/1989 | Pulkowski et al. | 162/358 |

FOREIGN PATENT DOCUMENTS

| | | | |
|---|---|---|---|
| 1048323 | 2/1979 | Canada | 162/358 |
| 0258169 | 3/1988 | European Pat. Off. . | |

*Primary Examiner*—Karen M. Hastings
*Attorney, Agent, or Firm*—Dirk J. Veneman; Raymond W. Campbell; David J. Archer

[57] ABSTRACT

An apparatus is disclosed for removing fluid from a fibrous web. The apparatus includes a press member and a blanket which cooperates with the press member for defining therebetween an elongate pressing section such that the web is pressed between the press member and the blanket during passage through the pressing section. An elongate press shoe urges the blanket towards the press member such that when the web passes through the pressing section, fluid is removed from the web. A heater is disposed adjacent to the press member for transferring heat to the web such that when the web passes through the pressing section, the web is subjected for an extended period to increase pressure and temperature so that water vapor generated within the pressing section during the passage of the web through the pressing section forces the fluid in the liquid phase away from the web. The press member has an outer surface which cooperates with the web. The outer surface of the press member defines a plurality of grooves having a width within the range 1 to 1,000 microns for the reception therein of steam and water expelled from the web during passage of the web through the pressing section.

14 Claims, 1 Drawing Sheet

APPARATUS AND METHOD FOR REMOVING FLUID FROM A FIBROUS WEB

BACKGROUND OF THE INVENTION

1. Field of the Invention

The present invention relates to an apparatus for removing fluid from a fibrous web. More particularly, the present invention relates to a heated extended nip press in which the web is subjected for an extended period to increase pressure and temperature.

2. Information Disclosure Statement

In the manufacture of a paper web from stock, stock is ejected from a headbox onto a forming wire where the stock is initially dewatered to form a fibrous web. The fibrous web is subsequently pressed between cooperating rolls to remove excess water therefrom. Subsequently, the pressed web is guided around a plurality of heated dryer drums for drying the web.

The drying section of a papermaking machine of necessity requires considerable expenditure in the terms of thermal input in order to complete the drying process. Consequently, it has long been appreciated by those skilled in the art that the more water that can be pressed from the web in the press section, the less heat is required to remove remaining water in the drying section.

Extended nip presses have met with much success in increasing the water removing capability in the press section. Essentially, the extended nip press includes a backing roll and a cooperating elongate shoe with a bearing blanket extending through the extended nip defined between the backing roll and the shoe. The blanket moves through the extended nip and supports the web therethrough such that the dwell time of the web during passage through the extended nip is increased. Such increased residence time allows more water to be pressed from the web when compared with the more conventional cooperating roll press.

More recently, and as taught in U.S. Pat. No. 4,738,752 assigned to Beloit Corporation, the application of heat to an extended nip press causes the evolution of water vapor that assists in driving off even greater quantities of water in the liquid phase from the extended nip, thereby removing more water from the web compared with the more conventional extended nip press section.

Nevertheless, although in the aforementioned U.S. Pat. No. 4,738,752, the backing roll included a porous surface for the reception of water expelled from the web, the provision of such porous surface has included certain disadvantages.

More particularly, it is advantageous that the web in certain applications run in physical contact with the outer surface of the backing roll. Therefore, the porous surface of the backing roll should be provided with pore sizes of a size sufficiently small that marking of the web is negligible.

However, although various proposals have been set forth in co-pending patent application No. 07/089,887, assigned to Beloit Corporation, specifically setting forth various pore sizes, there exists a tendency for such porous surfaces to disintegrate under extended use of the heated extended nip press.

If the backing roll is not vented, the release of the internal pressure of steam from the paper when the web emerges from the extended nip press disrupts and damages the sheet structure and causes delamination thereof.

Although porous sintered metal surfaces have been used successfully on a laboratory scale in order to avoid the problem of delamination, the production of a high temperature porous backing roll for commercial application has proved difficult. The manufacture of a porous backing roll has been difficult particularly in view of the following problem. The sintered metal coating is composed of tiny particles with very small inter-particle bonding areas. When a relatively small stress is applied to a piece of sintered metal, much larger stresses occur at these bonding regions. Such larger stresses result in poor mechanical properties of the structure. Additionally, large sintered metal parts, such as backing rolls, are difficult to manufacture using current equipment and technology.

The present invention seeks to overcome the aforementioned problem by providing a plurality of very small grooves, or channels, along the surface of the backing roll. Such grooves allow the escape of fluid from the paper being dried. The aforementioned grooves provide sufficiently large inter-channel regions in order to give good mechanical integrity to the surface of the roll.

Therefore, it is a primary object of the present invention to provide an apparatus for removing fluid from a fibrous web that overcomes the aforementioned inadequacies of the prior art devices and which makes a considerable contribution to the art of high temperature extended nip pressing.

Another object of the present invention is the provision of an apparatus for removing fluid from a fibrous web in which the press member or backing roll has an outer surface which cooperates with the web and defines a plurality of grooves having a width within the range 1 to 1,000 microns for the reception therein of steam and water expelled from the web during passage of the web through the pressing section.

Another object of the present invention is the provision of an apparatus for removing fluid from a fibrous web in which each of the grooves has a depth within the range 5 to 600 microns and wherein each groove is spaced at a distance within the range 200 to 300 microns relative to an adjacent groove, the grooves extending circumferentially around a press roll.

Another object of the present invention is the provision of an apparatus for removing fluid from a fibrous web, the apparatus including a belt that extends through the pressing section. The belt surface defines a plurality of grooves which extend in a machine direction, such grooves having a width within the range 1 to 1,000 microns for the reception therein of steam and water expelled from the web during passage of the web through the pressing section.

Other objects and advantages of the present invention will be readily apparent to those skilled in the art by a consideration of the detailed description contained hereinafter taken in conjunction with the annexed drawings.

SUMMARY OF THE INVENTION

The present invention relates to an apparatus and method for removing fluid from a fibrous web. The apparatus includes a press member and a blanket means which cooperate with the press member for defining therebetween an elongate pressing section. The arrangement is such that the web is pressed between the press member and the blanket means during passage through the pressing section. An elongate press shoe urges the blanket means towards the press member such that when the web passes through the pressing section, fluid is removed from the web. Heating means is disposed adjacent to the press member for transferring heat to the web such that when the web passes through the pressing section, the web is subjected for an extended period to increased pressure and temperature. The arrangement is such that water vapor generated within the pressing section during the passage of the web through the pressing section forces the fluid in the liquid phase away from the web.

The press member has an outer surface which cooperates with the web. The surface defines a plurality of grooves having a width within the range 1 to 1,000 microns for the reception therein of steam and water expelled from the web during passage of the web through the pressing section.

In a more specific embodiment of the present invention, each groove of the plurality of grooves extends at least 50 microns along the surface of the press member and has a depth within the range 5 to 600 microns.

In a preferred embodiment of the present invention, the press member is a press roll in which each groove of the plurality of grooves has a depth within the range 5 to 600 microns. Furthermore, each groove is spaced at a distance within the range 200 to 300 microns relative to an adjacent groove. The grooves extend circumferentially around the press roll with the grooves being spaced and parallel relative to each other.

The grooves are formed by either an etching, engraving, electro-forming, laser drilling, or a knurling process.

In a preferred embodiment of the present invention, the grooves extend in a machine direction.

In an alternative embodiment of the present invention, the apparatus further includes a belt means which extends through the pressing section. The belt means is disposed between the web and the press member. The belt means has a surface which cooperates with the web, the surface defining a plurality of grooves which extend in a machine direction. Each groove of the plurality of grooves has a width within the range 1 to 1,000 microns. The surface of the belt means has an electroformed coating which cooperates with the web, the coating defining the plurality of grooves.

Each groove of the plurality of grooves has a depth within the range 150 to 200 microns and is spaced within the range 4 to 600 microns relative to an adjacent groove.

The present invention also includes a method for removing fluid from a fibrous web, which includes the steps of urging an elongate press shoe towards a press member such that a blanket disposed between the press shoe and the press member defines an elongate pressing section between the blanket and the press member.

A web supported by the blanket is moved through the pressing section so that fluid is removed from the web.

The press member is heated such that heat is transferred to the web so that when the web passes through the pressing section, the web is subjected for an extended period to increased pressure and temperature so that water vapor generated within the pressing section during the passage of the web through the pressing section forces the fluid in the liquid phase away from the web.

Water and steam expelled from the web during passage of the web through the pressing section is received within a plurality of grooves which are defined along the outer surface of the press member. Each of the grooves has a width within the range 1 to 1,000 microns.

Many variations and modifications of the present invention will be readily apparent to those skilled in the art by a consideration of the detailed description contained hereinafter taken in conjunction with the annexed drawing. However, such modifications and variations fall within the spirit and scope of the present invention as defined by the appended claims.

BRIEF DESCRIPTION OF THE DRAWING

Similar reference characters refer to similar parts throughout the various embodiments of he present invention.

DETAILED DESCRIPTION OF THE DRAWINGS

Figure 1:
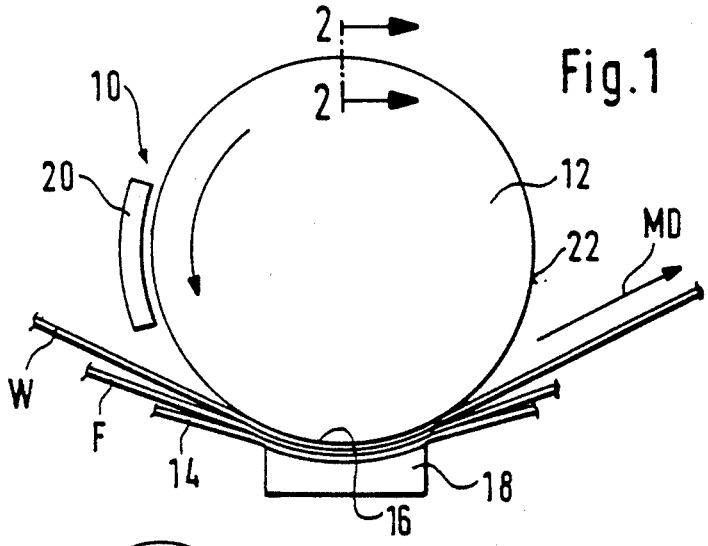
FIG. 1 is a side-elevational view of a heated extended nip press apparatus according to the present invention.

FIG. 1 is a side-elevational view of an apparatus generally designated 10 for removing fluid from a fibrous web W. The apparatus 10 includes a press member 12 and a blanket means 14 which cooperate with the press member 12 for defining therebetween an elongate pressing section 16 such that the web W is pressed between the press member 12 and the blanket means 14 during passage through the pressing section 16.

An elongate press shoe 18 urges the blanket means 14 towards the press member 12 such that when the web W passes through the pressing section 16, fluid is removed from the web W.

Heating means generally designated 20 is disposed adjacent to the press member 12 for transferring heat to the web W such that when the web W passes through the pressing section 16, the web W is subjected for an extended period to increased pressure and temperature so that water vapor generated within the pressing section 16 during the passage of the web W through the pressing section 16 forces the fluid in the liquid phase away from the web W.

The press member has an outer surface 22 which cooperates with the web W. Additionally a felt F is disposed between the blanket means 14 and the web W.

Figure 2:
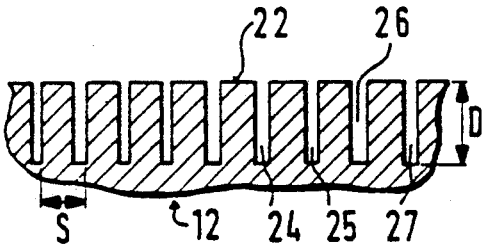
FIG. 2 is an enlarged sectional view taken on the line 2—2 of FIG. 1 showing a plurality of grooves formed in the surface of a press member according to the present invention.

FIG. 2 is an enlarged sectional view taken on the line 2—2 of FIG. 1. The outer surface 22 of the press member 12 defines a plurality of grooves 24, 25, 26 and 27 having a width within the range 1 to 1,000 microns for the reception therein of steam of water expelled from the web W during passage of the web W through the pressing section 16.

Each groove of the plurality of grooves 24 to 27 shown in FIG. 2 extends at least 50 microns along the surface 22.

As shown in FIG. 2, each groove has a depth D within the range 5 to 600 microns and preferably 500 microns.

In each of the embodiments described in the present invention, press member 12 is a press roll, and in one embodiment of the present invention, the grooves extend at least 50 microns along the surface 22. The grooves are spaced at a distance relative to each other within the range 2 to 300 microns and preferably have a spacing S shown in FIG. 2 of 250 microns.

As shown in FIGS. 1 and 2, each groove of the plurality of grooves 24 to 27 extends circumferentially around the press roll 12 with the grooves 24 to 27 being spaced and parallel relative to each other.

The grooves 24 to 27 are formed on the surface 22 of the press member 12 by either an etching, engraving, electro-forming, laser drilling or a knurling process, and the grooves extend in a machine direction as indicated by the arrow MD.

Figure 3:
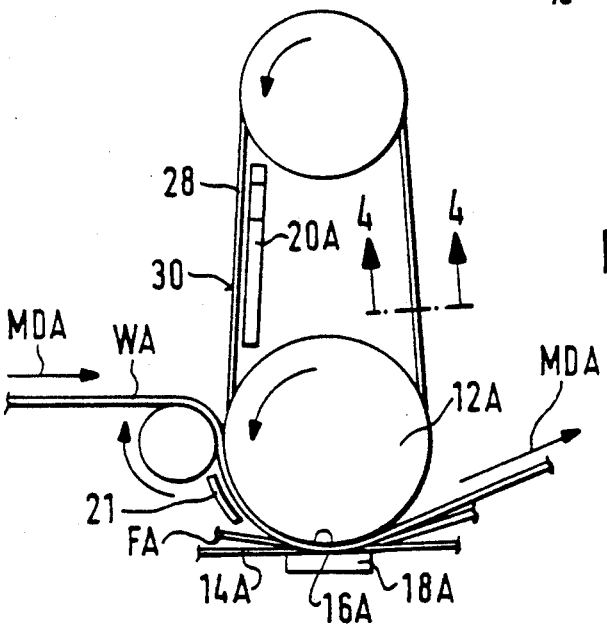
FIG. 3 is an enlarged sectional view of a further embodiment of the present invention showing a belt means having a plurality of grooves defined by a coating formed on the surface of the belt means.
Figure 4:
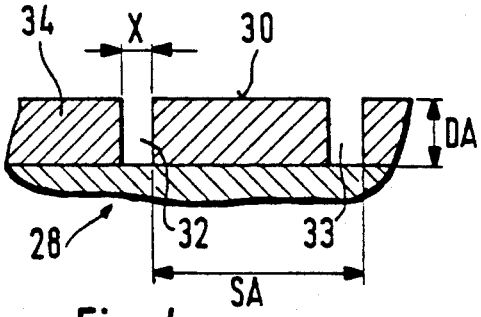
FIG. 4 is an enlarged sectional view taken on the line 4—4 of FIG. 3.

In an alternative embodiment of the present invention as shown in FIG. 3, a belt means 28 extends through the pressing section 16A with the belt means 28 being disposed between a web WA and a press member 12A. The belt means 28 has a surface 30 which cooperates with the web WA. The belt surface 30 defines a plurality of grooves 32,33 as shown in FIG. 4 which is a magnified sectional view taken on the line 4—4 of FIG. 3. The grooves 32,33 extend in a machine direction as indicated by the arrow MDA. Each groove of the plurality of grooves 32,33 have a width X within the range 1 to 1,000 microns and preferably have a width X of 75 microns.

As shown in FIG. 4, the surface 30 of the belt means generally designated 28 has an electro-formed coating 34 which cooperates with the web WA. The coating 34 defines the plurality of grooves 32,33, which each have a depth DA within the range 150 to 250 microns and preferably a depth of 175 microns an are spaced relative to each other at a distance SA within the range 4 and 600 microns and preferably have a distance SA of 500 microns between grooves.

In operation of the apparatus, the web W supported by the blanket 14 and the felt F moves through the pressing section 16 such that water is pressed from the web W. The heating means 20, which may be an induction heater, heats the outer surface 22 of the backing roll, or press roll, 12 so that water vapor is generated within the pressing section 16 for expelling water in the liquid phase out of the web W. Although some of the water in the liquid phase is absorbed by the felt F and is conducted away from the pressing section 16 by the blanket 14 if the blanket 14 is grooved, another portion of water is removed from the pressing section by the plurality of grooves 24 to 27 which extend in a machine direction circumferentially around the roll 12. The grooves are of microscopic proportions and are spaced such that the structural integrity of the outer surface 22 of the roll 12 is maintained.

Similarly, in the alternative embodiment of the present invention, a belt 28 is heated by means of an induction heater 20A so that the outer surface 20 of the belt 28 heats the web WA. Accordingly, the web WA is subjected to increased temperature for an extended period of time during passage of the web WA through the pressing section 16A. Water in the liquid phase is received within a plurality of machine direction grooves 32,33 formed in the outer surface 30 of the belt 28 so that such water is removed from the web. Further, heat can be supplied to the backing roll 12A by means of a further heater 21, such as an induction heater.

The present invention enables the web to be adequately vented while providing structural integrity to the press apparatus.

What is claimed is:

1. An apparatus for removing fluid from a fibrous web, said apparatus comprising:

a press member;

blanket means cooperating with said press member for defining therebetween an elongate pressing section such that the web is pressed between said press member and said blanket means during passage through said pressing section;

an elongate press shoe for urging said blanket means towards said press member such that when the web passes through said pressing section, fluid is removed from the web;

heating means disposed adjacent to said press member for transferring heat to the web such that when the web passes through said pressing section, the web is subjected for an extended period to increased pressure and temperature so that water vapor generated within said pressing section during the passage of the web through said pressing section forces the fluid in the liquid phase away from the web; and said press member having an outer surface which cooperates in physical contact with the web, said surface defining a plurality of grooves having a width within the range 1 to 1,000 microns for the reception therein of steam and water expelled from the web during passage of the web through said pressing section.

2. A press apparatus as set forth in claim 1 wherein each groove of said plurality of grooves extends at least 50 microns along said surface, and having a width less than 50 microns.

3. A press apparatus as set forth in claim 1 wherein each groove of said plurality of grooves has a depth within the range 5 to 600 microns.

4. A press apparatus as set forth in claim 1 wherein said press member is a press roll.

5. A press apparatus as set forth in claim 4 wherein each groove of said plurality of grooves extends at least 50 microns along said surface, and having a width less than 50 microns.

6. A press apparatus as set forth in claim 4 wherein each groove of said plurality of grooves has a depth within the range 5 to 600 microns.

7. A press apparatus as set forth in claim 4 wherein each groove of said plurality of grooves is spaced at a distance within the range 200 to 300 microns relative to an adjacent groove.

8. A press apparatus as set forth in claim 4 wherein each groove of said plurality of grooves extends circumferentially around said press roll, said grooves being spaced and parallel relative to each other.

9. A press apparatus as set forth in claim 4 wherein each groove of said plurality of grooves is an etched groove.

10. A press apparatus as set forth in claim 4 wherein each groove of said plurality of grooves is an engraved groove.

11. A press apparatus as set forth in claim 4 wherein each groove of said plurality of grooves is an electro-formed groove.

12. A press apparatus as set forth in claim 4 wherein each groove of said plurality of grooves is a laser drilled groove.

13. A press apparatus as set forth in claim 4 wherein each groove of said plurality of grooves is a knurled groove.

14. A press apparatus as set forth in claim 4 wherein each groove of said plurality of grooves extends in a machine direction.

* * * * *

UNITED STATES PATENT AND TRADEMARK OFFICE

CERTIFICATE OF CORRECTION

PATENT NO. : 5,152,874

DATED : October 6, 1992

INVENTOR(S) : Samuel F. Keller

It is certified that error appears in the above—identified patent and that said Letters Patent is hereby corrected as shown below:

Column 4, Line 30: Please delete "he" and insert ---the--- in place thereof.

Signed and Sealed this

Twelfth Day of October, 1993

Bruce Lehman

*Attest:*

BRUCE LEHMAN

*Attesting Officer*

*Commissioner of Patents and Trademarks*